United States Patent [19]

Fibus

[11] Patent Number: 4,627,566

[45] Date of Patent: Dec. 9, 1986

[54] NEWSPAPER DELIVERY TUBE WITH NEWSPAPER RETAINING FLAPS

[75] Inventor: C. Kenneth Fibus, Youngstown, Ohio

[73] Assignee: The Steel City Corporation, Youngstown, Ohio

[21] Appl. No.: 757,422

[22] Filed: Jul. 22, 1985

[51] Int. Cl.[4] ..... B65D 91/00

[52] U.S. Cl. ..... 232/1 C; 232/17

[58] Field of Search ..... 232/1 C, 17, 38

[56] References Cited

U.S. PATENT DOCUMENTS

| | | | |
|---|---|---|---|
| 2,120,857 | 6/1938 | Crawford et al. | 232/1 C |
| 2,709,038 | 5/1955 | Marcus et al. | 232/17 |
| 3,134,538 | 5/1964 | Fibus | 232/17 |
| 3,181,782 | 5/1965 | Monroe | 232/1 C X |
| 3,275,228 | 9/1966 | Golla | 232/1 C X |
| 3,556,393 | 1/1971 | Fibus et al. | 232/17 |
| 4,260,090 | 4/1981 | Gross | 232/1 C X |

*Primary Examiner*—Robert P. Swiatek

*Attorney, Agent, or Firm*—Harpman & Harpman

[57] ABSTRACT

An integrally molded newspaper delivery tube comprising an open end receptacle for newspapers has a plurality of newspaper retaining flaps inwardly of the open end thereof for engaging and holding a newspaper positioned in the delivery tube.

9 Claims, 4 Drawing Figures

NEWSPAPER DELIVERY TUBE WITH NEWSPAPER RETAINING FLAPS

BACKGROUND OF THE INVENTION

1. Technical Field

This invention relates to newspaper delivery or motor route tubes of the type normally used by newspapers for facilitating delivery of newspapers along rural roads and the like.

2. Description of the Prior Art

Prior structures of this type comprise various shaped tubes which have been mounted on angle brackets by fastener means so as to enable the tubes to be supported on posts.

U.S. Pat. No. 2,709,038 illustrates an early form of newspaper delivery route tube made of metal and produced in large numbers over a number of years by the assignee of the present patent application, The Steel City Corporation.

U.S. Pat. No. 3,134,538 illustrates an integrally molded newspaper delivery tube produced in large numbers over many years by the assignee of the present application, The Steel City Corporation, and U.S. Pat. No. 3,556,393 illustrates an integrally molded newspaper delivery tube produced in large numbers over the many years since its inception by the assignee of the present application, The Steel City Corporation of Youngstown, Ohio.

SUMMARY OF THE INVENTION

A newspaper delivery or motor route tube comprises an integrally molded open ended receptacle adapted to be mounted on a post for the reception of folded newspapers and has a plurality of upstanding flaps positioned adjacent the open end of the receptacle forming means preventing the newspaper from being accidentally moved out of the newspaper delivery or motor route tube unless the same is manually lifted over the upstanding flaps. Arms on the flaps hold the same in upstanding relation to the bottom of the newspaper delivery or motor route tube from which they are formed. The bottom of the newspaper delivery or motor route tube is provided with dual transverse reinforcing means adjacent the flaps, one of the reinforcing means forming an enlarged rib about the open end of the receptacle.

DESCRIPTION OF THE PREFERRED EMBODIMENT

Figure 1:
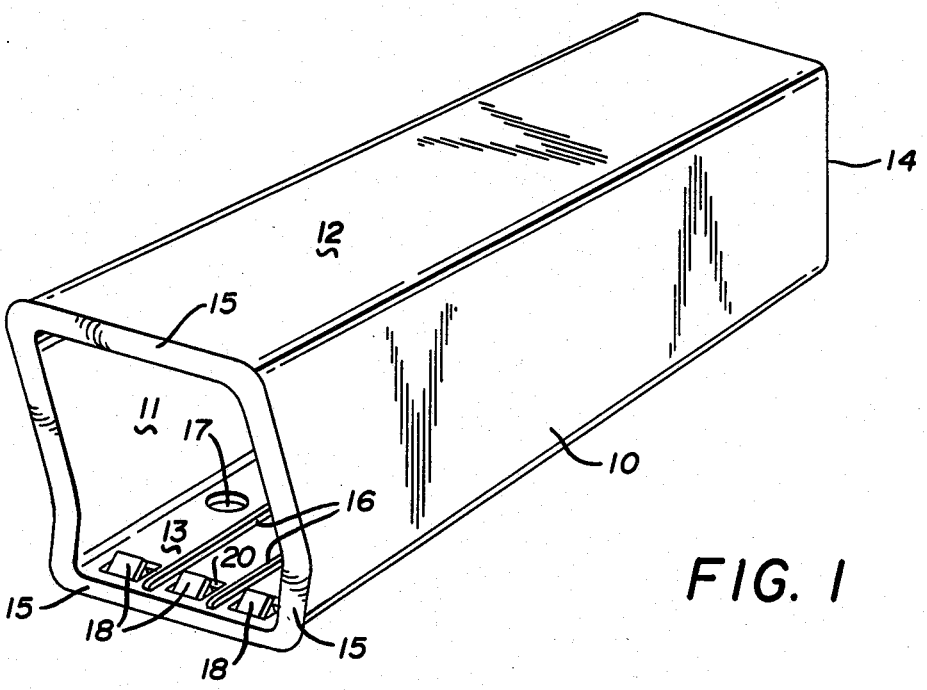
FIG. 1 is a perspective view of the newspaper delivery or motor route tube with the upstanding flaps inwardly of the open end thereof.

By referring to the drawings and FIG. 1 in particular, a motor route tube or a newspaper delivery tube may be seen in perspective in upright position as it is positioned when mounted on a post alongside a rural road or other newspaper delivery route. The bottom of the tube has an integrally molded configuration similar to that of U.S. Pat. No. 3,556,393 for the reception of an angle bracket, not shown, by which the tube is mounted on the post, not shown, as disclosed in said patent.

The tube is an open end intregally molded receptacle having side walls 10 and 11 and top and bottom walls 12 and 13, respectively, and a closed end 14. The open end of the tube is defined by a substantially sized continuous cross sectionally rounded reinforcing rib 15 and the upper portion of the tube is preferably angled outwardly to form an extension serving to protect a newspaper positioned in the tube from rain and the like.

Still referring to FIG. 1 of the drawings, it will be seen that there are a pair of longitudinally extending raised ribs 16 on the upper surface of the bottom 13 of the tube and that one or more drainage openings 17 are provided in the bottom 13 of the tube.

The present invention relates to the formation of a plurality of upstanding flaps 18 inwardly of the open end of the tube and relatively close to the reinforcing rib 15 where it extends across the lower front edge of the tube. The upstanding flaps 18 are shown in upstanding position in FIG. 1 of the drawings and in broken lines in FIG. 4 of the drawings and it will be observed that when they are in upstanding position as shown in FIG. 1 of the drawings, which is their normal position, a folded newspaper positioned in the tube will engage the upstanding flaps 18 which will prevent the folded newspaper from being accidentally removed from the tube, as for instance by the partial vacuum caused by a passing vehicle.

Figure 2:
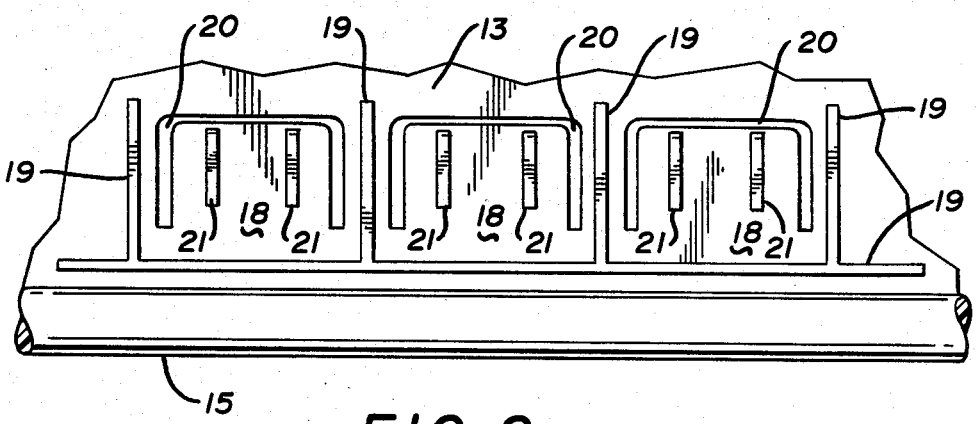
FIG. 2 is an enlarged bottom plan view of a portion of the device shown in FIG. 1.

By referring now to FIG. 2 of the drawings, an enlarged bottom plan view of the lower front portion of the tube of FIG. 1 may be seen with the bottom of the bottom wall 13 having a first reinforcing multiple flange configuration 19 formed thereon and a plurality of U-shaped openings 20 formed therein adjacent and between the several reinforcing multiple flange configurations 19. The U-shaped openings 20 define the plurality of flaps 18, each of which has a pair of spaced triangular legs 21 thereon as best seen in FIGS. 3 and 4 of the drawings.

Still referring to FIG. 2 of the drawings, it will be seen that the reinforcing rib 15 is closely spaced to the reinforcing multiple flange configuration 19 so that the bottom wall 13 adjacent the open end of the tube will remain in desired horizontal position and unaffected by the positioning of the U-shaped openings 20 adjacent thereto.

Figure 4:
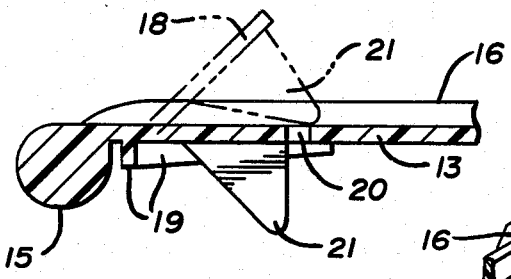
FIG. 4 is a vertical section taken on line 4—4 of FIG. 3. Broken lines in FIG. 4 show the position of the flaps in upstanding position.
Figure 3:
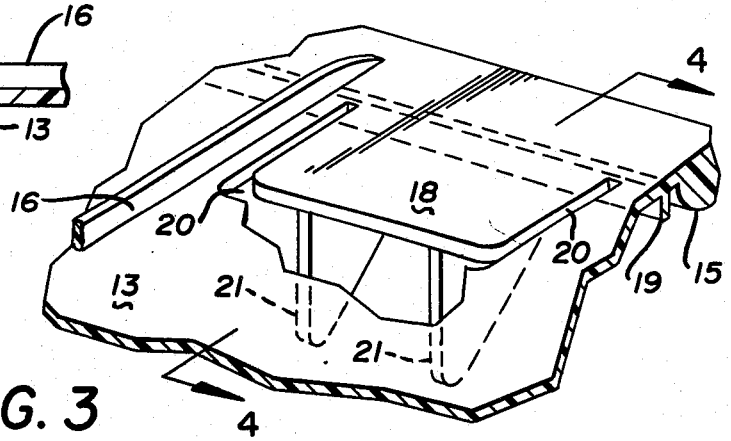
FIG. 3 is an enlarged perspective elevation of a portion of the device seen in FIG. 1.

In FIGS. 2,3 and 4 of the drawings, the plurality of upstanding flaps 18 are shown in molded position wherein the flaps 18 are on the same plane as the bottom wall 13 of the newspaper delivery or motor route tube.

In FIG. 4 of the drawings, broken lines show one of the flaps 18 in normal upstanding position with its integral triangularly shaped legs 21 engaging the bottom wall 13 adjacent the U-shaped opening 20 which becomes a rectangular opening when the flap 18 is moved to its normal upstanding position as shown in FIG. 1 of the drawings and in broken lines in FIG. 4 of the drawings.

In FIG. 3 of the drawings, a portion of the bottom wall 13 of the tube has been broken away to illustrate the position of the flap 18 and its triangularly shaped legs 21 in molded condition and a portion of one of the longitudinally extending raised ribs 16 is illustrated.

It will occur to those skilled in the art that the construction is such that the newspaper delivery or motor route tube disclosed herein may be molded integrally of suitable synthetic resin, such as polyethylene or the like.

The newspaper delivery or motor route tube disclosed herein is cross sectionally somewhat larger at its open end than at its closed end and its top wall 12 tapers from the reinforcing rib 15 across its upper surface at its open end to the integrally molded closed end 14. The side walls 10 and 11 also taper slightly from the largest spacing of the forward ends of the side walls to the closed end 14.

In placing the newspaper delivery or motor route tube disclosed herein in use, the flaps 18 are manually bent upwardly from the positions shown in solid lines in FIGS. 2,3 and 4 of the drawings to the positions shown in FIG. 1 by distorting the synthetic resin from which the tube and the upstanding flaps 18 are integrally formed. When the upstanding flaps 18 are moved to the position shown in broken lines in FIG. 4 of the drawings and in solid lines in FIG. 1 of the drawings, the triangular legs 21 on each of the flaps 18 will distort slightly as they move past the edges of the bottom wall 13 defining the openings 20 and will then be in position over the upper surface of the bottom wall 20 adjacent the openings 20 so as to keep the flaps 18 in upstanding position.

It will also be seen that each of the uppermost edges of the flaps 18 project slightly beyond the triangular legs 21 so that a small but effective configuration for engaging the edges of a folded newspaper positioned in the tube is realized.

The above described structure provides a relatively easy and fast formation of the upstanding flaps which act effectively in preventing the accidental withdrawal of a folded newspaper from the newspaper delivery or motor route tube in which the same are formed as herein disclosed.

Although but one embodiment of the present invention has been illustrated and described, it will be apparent to those skilled in the art that various changes and modifications may be made therein without departing from the spirit of the invention and having thus described my invention, what I claim is:

1. A newspaper delivery tube for the deposit of newspapers and the like having means for retaining newspapers therein and comprising a tubular body having upper, lower and side walls with inner and outer surfaces and an open end and a closed end, said newspaper retaining means consisting of a plurality of flaps normally extending upwardly from said inner surface of said lower wall and positioned transversely of said lower wall and adjacent said open end of said tubular body, said tubular body being formed of a resilient deformable synthetic resin with said flaps formed in said lower wall in first positions on a plane common with said lower wall and movable to second positions upstanding with respect to said first positions, means on said flaps for normally holding the same in said upstanding second positions relative to said lower wall of said tubular body.

2. The newspaper delivery tube set forth in claim 1 and wherein said elongate tubular body is rectangular in cross section at its open end with said side walls having a known vertical dimension and said upper and lower walls having a known transverse dimension, said known vertical dimension being greater than said known transverse dimension.

3. The newspaper delivery tube set forth in claim 1 and wherein said flaps are rectangular and are formed in said lower wall of said tubular elongate body by U-shaped openings therein defining three sides of each of said flaps.

4. A newspaper delivery tube for the deposit of newspapers and the like having integral reinforcing and newspaper retaining means and comprising a tubular body having upper, lower and side walls with outer and inner surfaces and an open end and a closed end, said integral reinforcing means being located at said open end on the outer surface of said tubular body, said newspaper retaining means consisting of a plurality of flaps normally extending upwardly from said inner surface of said lower wall and transversely of said tubular body and positioned adjacent said open end of said tubular body and the reinforcing means thereabout, said tubular body being formed of a resilient deformable synthetic resin with said flaps formed in said lower wall in first positions on a plane common with said lower wall and movable to second positions upstanding with respect to said first positions, means on said flaps for normally holding the same in said upstanding second positions relative to said lower wall of said tubular body.

5. The newspaper delivery tube set forth in claim 4 wherein said integral reinforcing means consists of an enlarged rib defining said open end of said tubular elongate body.

6. The newspaper delivery tube set forth in claim 4 and wherein said elongate tubular body is rectangular in cross section at its open end with said side walls having a known vertical dimension and said upper and lower walls having a known transverse dimension, said known vertical dimension being greater than said known transverse dimension.

7. The newspaper delivery tube set forth in claim 4 and wherein said flaps are rectangular and are formed in said lower wall of said tubular elongate body by U-shapd openings therein defining three sides of each of said flaps.

8. The newspaper delivery tube set forth in claim 4 and wherein said means on said flaps for holding the same in said upstanding positions relative to said lower wall consists of legs depending from said flaps of a size for engagement with said inner surface of said lower wall when said flaps are moved to said upstanding positions.

9. The newspaper delivery tube set forth in claim 8 and wherein said legs are generally triangular and depend from said flaps a known dimension and wherein said U-shaped openings are of a known dimension and the known dimension of said depending legs is greater than the known dimension of said U-shaped openings in said lower wall of said tubular elongate member.

* * * * *